US006618886B2

(12) United States Patent
Herren

(10) Patent No.: US 6,618,886 B2
(45) Date of Patent: Sep. 16, 2003

(54) CAN OPENER

(75) Inventor: Bruno Herren, Bern (CH)

(73) Assignee: Moha Moderne Haushaltwaren AG, Zollikofen (CH)

( * ) Notice: Subject to any disclaimer, the term of this patent is extended or adjusted under 35 U.S.C. 154(b) by 22 days.

(21) Appl. No.: 09/729,619

(22) Filed: Dec. 4, 2000

(65) Prior Publication Data

US 2001/0022030 A1 Sep. 20, 2001

(30) Foreign Application Priority Data

Dec. 3, 1999 (CH) ..... 2227/99

(51) Int. Cl.[7] ..... B25F 1/00

(52) U.S. Cl. ..... 7/152; 81/3.08; 81/3.55; 81/3.57; 30/408

(58) Field of Search ..... 7/118, 161, 152; 30/408, 413, 450; D8/41; 81/3.68, 3.55, 3.57; 220/281, 284, 285, 277

(56) References Cited

U.S. PATENT DOCUMENTS

| | | | | | |
|---|---|---|---|---|---|
| 1,451,542 | A | * | 4/1923 | Ftyklo | 30/408 X |
| 1,562,580 | A | * | 11/1925 | Nordhaus | 30/417 |
| 1,684,622 | A | * | 9/1928 | Harker | 30/408 X |
| 2,391,732 | A | * | 12/1945 | Mirando | 30/408 X |
| 2,980,996 | A | * | 4/1961 | Beran | 7/118 X |
| 3,142,903 | A | * | 8/1964 | Stiller | 30/450 |
| 3,315,353 | A | * | 4/1967 | Thomas | 30/416 |
| 3,825,961 | A | * | 7/1974 | Klein | 7/118 X |
| 4,187,607 | A | * | 2/1980 | Simuro et al. | 7/118 X |
| D267,925 | S | | 2/1983 | La Mancusa | |
| D289,365 | S | * | 4/1987 | Lee | D8/41 |
| D291,960 | S | * | 9/1987 | Kerti | D8/18 |
| D294,449 | S | * | 3/1988 | Kuhn | D8/34 |
| 4,782,594 | A | | 11/1988 | Porucznik et al. | |
| 4,805,303 | A | * | 2/1989 | Gibbs | 7/118 X |
| D301,539 | S | * | 6/1989 | Cheung | D8/41 |
| 5,018,409 | A | | 5/1991 | Bittel | |
| D339,042 | S | * | 9/1993 | Friend | D8/42 |
| 5,416,940 | A | * | 5/1995 | Bandera | 7/118 |
| D362,379 | S | * | 9/1995 | Tekaat | D8/41 |
| 5,787,592 | A | * | 8/1998 | Lai | 30/418 |
| D404,270 | S | * | 1/1999 | Chang | D8/40 |
| D405,332 | S | * | 2/1999 | So | D8/39 |
| D406,027 | S | * | 2/1999 | So | D8/41 |
| D406,222 | S | * | 3/1999 | Wong | D8/40 |
| 5,946,811 | A | * | 9/1999 | Chang | 30/417 |
| D415,666 | S | * | 10/1999 | Ho | D8/41 |
| 6,058,613 | A | * | 5/2000 | So | 30/418 |
| 6,094,828 | A | * | 8/2000 | Chong | 30/417 |
| 6,105,468 | A | * | 8/2000 | Fohrman et al. | 81/3.55 |
| 6,148,527 | A | * | 11/2000 | Pereira | 30/418 |
| D436,508 | S | * | 1/2001 | Roberts | D8/41 |
| D441,626 | S | * | 5/2001 | Greiner | D8/41 |
| D442,044 | S | * | 5/2001 | Juhlin et al. | D8/40 |
| D459,962 | S | * | 7/2002 | Chong | D8/40 |
| D460,330 | S | * | 7/2002 | Huang | D8/43 |
| D466,771 | S | * | 12/2002 | Chang | D8/41 |
| D471,412 | S | * | 3/2003 | Greiner | D8/41 |

FOREIGN PATENT DOCUMENTS

DE 298 02 030 U1 6/1998

* cited by examiner

*Primary Examiner*—Allan N. Shoap
*Assistant Examiner*—Jason Prone
(74) *Attorney, Agent, or Firm*—Pauley Petersen Kinne & Erickson

(57) ABSTRACT

An opener having a grip-like body in which at one end is integrated a cutting mechanism for cutting open tins. An oppositely-lying thickened end has a receiving groove in which a pull hook is pivotally mounted about a pivot pin over a predetermined angle. For opening tear-open lids, a pull-ring is captured within an attachment recess on a pull hook inner edge. When pivoting the grip-like body the pull hook rolls along a rolling back of the pull hook, on the can lid and pulls up.

13 Claims, 3 Drawing Sheets

CAN OPENER

BACKGROUND OF THE INVENTION

1. Field of the Invention

This invention relates to a combined can opener for separating a lid from a can and for tear-opening a can.

2. Description of Prior Art

For years the applicant has successfully produced and marketed can openers for opening conventional cans. With many conventional systems the can lid is cut through along an inner edge and separated from a lateral wall of the can. Since the separated part of the lid is sharp-edged and may cause injury, in the last years so-called safety can openers have been introduced which cut through the can lid along an outer edge. The connection between the can wall and the lid is released without sharp edges remaining on the lid to be removed or on the can edge. Because the cutting wheel does not contact the can contents the cutting mechanics of the opener are not dirtied and the can contents are protected from contamination from the cutting mechanics.

Such safety can openers are for example known from U.S. Pat. No. 4,782,594 and German Patent Reference 298 02 030. For both cutting principles, pincer models as well as one-armed models are known.

In order to open cans without a can opener, the packaging industry offers cans wherein the lid is released, by a pull or tear-open ring, from the can along a peripheral break-off line. Such tear-open cans are more complicated to manufacture and thus more expensive than conventional cans. The break-off lines create tight manufacturing tolerances and are thus more susceptible to erroneous functions.

If for example a material thickness along the break-off line is too great, then opening requires the application of a considerable pulling force. Older or weaker persons opening such a can causes particular problems.

U.S. Pat. No. 5,018,409 discloses an opener for tear-open cans. On the front end of this opener on an upper side there is a recess which defines a lug for suspending the tear-open ring. The rear part of the flat opener is formed parabolically and blends into a narrower grip part. For opening a tear-open can, the ring attached on the lid at the edge is lifted up and at the same time the break-off line directly in front of the ring is broken through, in the known manner. Now the ring is suspended into the recess on the front end of the opener and by pressure on the grip part while exploiting the lever arm, the can lid is released from the can. The opener at the same time with its parabolic back is rolled over the can lid and simultaneously the lid region which carries the tear-open ring is lifted and pulled upwards and to the rear. The opener which, for example, may be punched from one piece of sheet metal is relatively narrow. The contact surface of the opener back on the can lid is therefore small and on account of this on opening a can of the opener may easily slip.

A further opener for tear-open cans is disclosed in the U.S. Design Pat. No. D 267,925. This opener is manufactured from a flat piece of sheet metal. It has a hook-like end for opening the tear-open can as well as an opposite end for opening bottles with crown tops. The very narrow opener can easily slip when being used.

If the two previously mentioned conventional openers are for opening larger cans then the conventional openers are designed correspondingly large, which makes them unwieldy and bulky.

Both of the previously mentioned conventional openers do not open conventional cans.

SUMMARY OF THE INVENTION

One object of this invention is to make available a space-saving can opener which permits all commercially available cans to be opened securely and comfortably and which does not have the previously mentioned disadvantages.

These objects are achieved by a device according to the features and embodiments described in the specification and in the claims.

The can opener according to this invention can open common types of can packagings otherwise opened with only a single apparatus and is ergonomic and has a functionally advantageous shape that offers comfort and safety. Furthermore, the opener according to this, invention can be stored in a space-saving manner.

BRIEF DESCRIPTION OF THE DRAWINGS

In the drawings are embodiments of this invention which are explained in the subsequent description, wherein.

DESCRIPTION OF PREFERRED EMBODIMENTS

Figure 1:
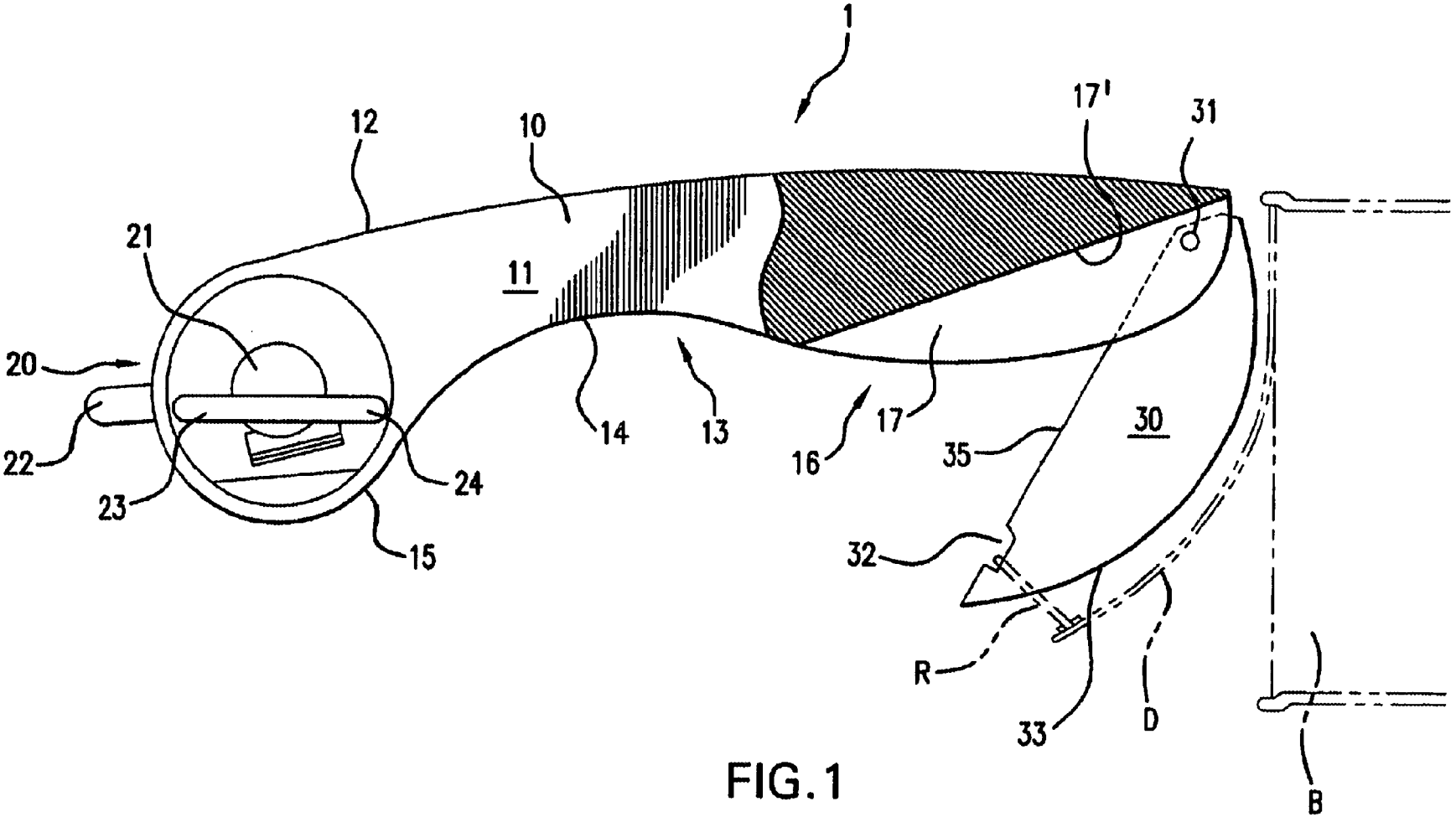
FIG. 1 is a side view of one embodiment of the opener according to this invention, with a folded out pull hook, wherein a body of the opener in a region of an attachment of the pull hook is shown in a partial cross section.
Figure 2:
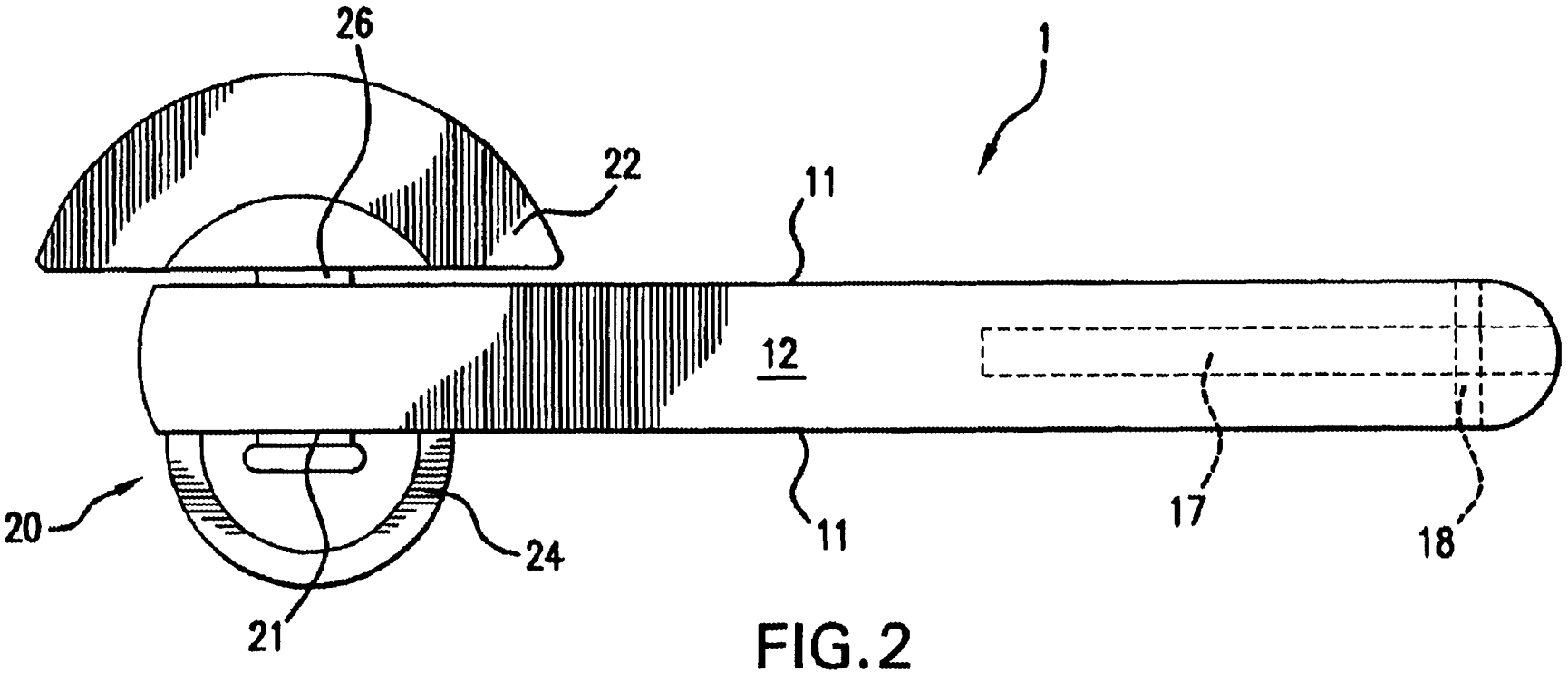
FIG. 2 is a top view of the can opener according to this invention, as shown in FIG. 1.
Figure 5:
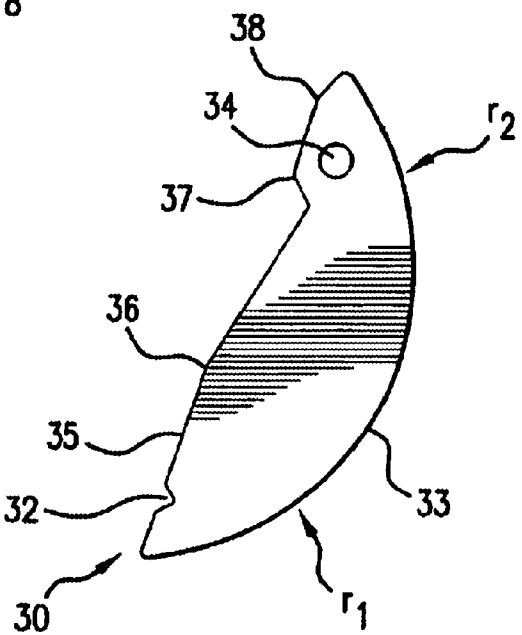
FIG. 5 is a side view of a pull hook according to this invention.
Figure 3:
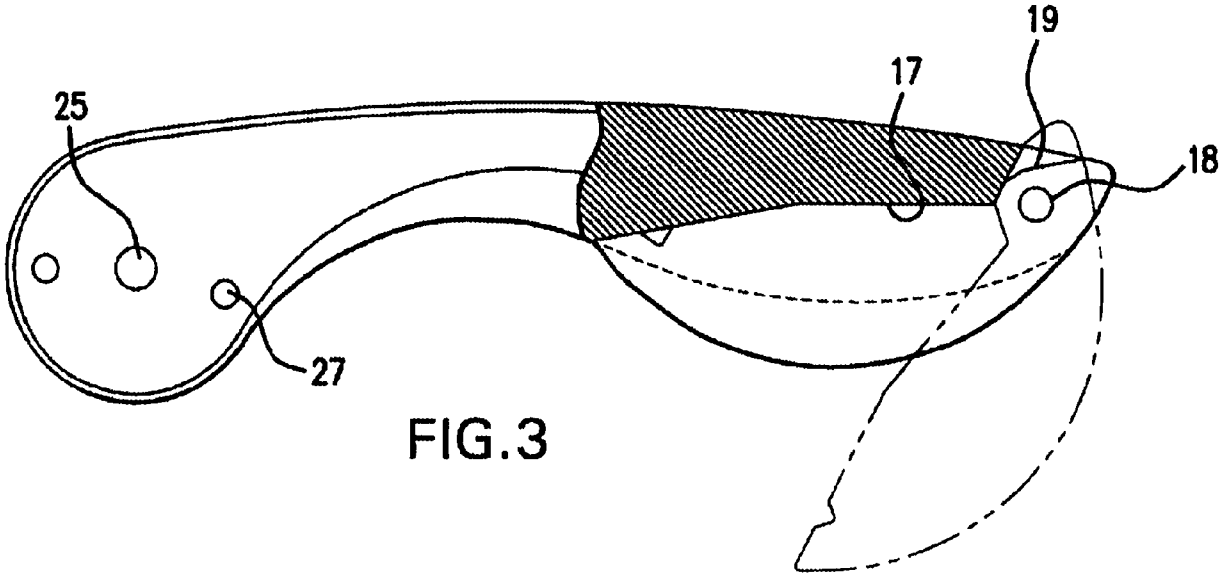
FIG. 3 is a side view of a further embodiment of the opener according to this invention, partly in cross section, with a folded-in pull hook, wherein the pull hook in a folded-out position is shown in phantom lines and the cutting mechanics are not shown.
Figure 4:
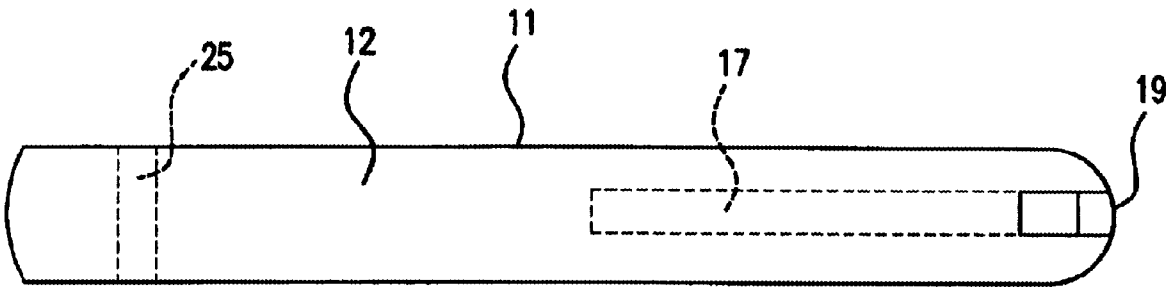
FIG. 4 is a top view of the can opener according to this invention, as shown in FIG. 3, wherein the cutting mechanics are not shown.

The drawings show two embodiments of the subject matter of this invention, which essentially differ in the design of the pull hook and the adaptations connected to the pull hook. For functionally equal elements in the following specification, the same reference numerals are applied. A first embodiment form is shown in FIGS. 1 and 2, having the cutting mechanism 20 while FIGS. 3 to 5 show a second embodiment form) wherein the cutting mechanism is omitted.

The opener as a whole is indicated with element reference numeral 1. This has, as an essential element, a grip-like body 10. The grip-like body 10 has two parallel, planar side surfaces 11 as shown in the top view of FIG. 2. The grip-like body 10 has an upper arcuate back surface 12 and an opposite lower curved surface 13. The curved lower surface 13 at one end there forms a head 15 in which the cutting mechanism 20 is accommodated and at the other end a thickened grip end 16 in which the pull hook 30 at least partly is accommodated. Between the head 15 and the thickened grip piece 16 there is formed a grip trough 14 in the curved lower surface 13. In the thickened grip end 16 centrally and parallel to the two side surfaces 11 there is a receiving groove 17. The receiving groove 17 begins at the thickened grip end 16 and is directed inclined towards the grip trough 14 runs out into the curved lower surface 13. The receiving groove 17 in the thickened grip end 16 forms two side cheeks which are transversely passed through by a pivoting axis bearing 18.

In the thickened head 15 there is located the cutting mechanism indicated as a whole at 20 which comprises a traction wheel 21 seated on a traction pin 26 in a rotationally secure manner. The traction pin 26 runs perpendicular to the planar side surfaces 11 and completely passes through the grip-like body 10. On that end of the traction pin 26 lying opposite the traction wheel 21 there is a rotary grip 22 by way of which the traction wheel 21 is actuated. Perpendicular to the traction pin 26 there runs a pin of the cutting wheel 23. The cutting wheel 23 during the actuation of the cutting mechanism lies on an outside on the weld bulge of the tin or can to be opened and cuts through the tin or can. A two-point contact bow 24 also lies on the upper edge of the can bulge. The cutting wheel 23 with the two-point contact bow 24 encloses an acute angle in order to produce a separating force directed upwards. Such cutting mechanisms are known.

In the receiving groove 17 of the grip-like body 10 there is partly accommodated a pivotal pull hook 30. The pull hook 30 is pivotable by a certain angle about a pivot pin 31 which passes through the pivot pin bearing 18. In the pivoted-in position the pull hook 30 with its pull hook inner edge 35 bears on the groove base 17'. In the pivoted-out condition the rear-side end near the pivot pin 31 comes to bear on the groove base 17' by which means the pivoting movement of the pull hook 30 is limited.

The pull hook 30 is a planar, relatively thick element. It can be formed of a steel plate or also of a high-strength, for example glass-fibre reinforced plastic. The pivot pin 31, which as already mentioned lies in the pivot pin bearing 18, passes through the pull hook 30. The pull hook 30 in the embodiment according to FIG. 1 has a straight-running pull hook inner edge 35 and a convex rolling back 33. At an end distant to the pivot pin 31 the pull hook 30 on the pull hook inner edge 35 comprises an attachment recess 32. On actuation the pull ring R lies in the attachment recess 32. The shape of the attachment recess 32 may be configured in any way but it must be formed so that the pull ring R during the actuation does not slip out of the attachment recess 32. This, for example, is achieved by an approximately rectangular or trapezoidal recess.

The course of the pull hook inner edge 35 is not of a direct importance. Instead of the straight course shown here the inner edge 35 may be shaped curving inwards or outwards. If the inner edge 35 is curved inwards then the pull hook 30 has more of a crescent-shape configuration, by which the strength of the pull hook itself is reduced. If however the inner edge 35 of the pull hook 30 is curved outwards then correspondingly the receiving groove must be deepened, respectively the groove base 17' be directed concavely inwards. This then accordingly leads to a reduction of the cross section of the grip-like body 10 in this region and accordingly to a certain weakening.

FIG. 5 shows an optimized form of the pull hook 30. The attachment recess 32 is located roughly at the opposite end to the pivot pin 34. In contrast to the embodiment form according to the FIGS. 1 and 2, the pull hook inner edge 35 is shown running straight and then slightly angled toward a pivot bow 37 which transitions into a contact edge 38. The rolling back 33 is shaped roughly equal to that of the previously described solution. Near the attachment recess the rolling back 33 has a radius $r_1$ while in the region near the pivot pin bearing 34 the rolling back 33 has a radius $r_2$. The radius $r_1$ is shown smaller than the radius $r_2$ and thus the pull ring R initially exerts a more upwardly directed pulling component. FIG. 1 schematically shows the opening operation in a dashed line. The pull ring R lies in the attachment recess 32 and the tear-open lid D is pulled upwards, while the pull hook 30 rolls on the not yet opened region of the lid of the tin B or can.

As already mentioned the pull hook 30 in the embodiment shown in FIG. 5 comprises the pull hook inner edge 35 running angled. With the angled location 36 the pivot pin bearing 34 is positioned practically above the extended pull hook inner edge 35. This permits the formation of the contact edge 38 which bears on the base of an abutment recess 19 in the grip-like body. With this configuration an improved force transfer from the pull hook 30 into the grip-like body 10 takes place. Simultaneously, however the pull hook 30 is rather reinforced while the cross section of the grip-like body with the angled course of the groove base 17' is slightly reduced and because at the same time the pivot axis 31 is practically arranged in the extension of the groove base 17', the force via the abutment surface is directly introduced into the stiffened region. In the previously described embodiment, practically the entire force was introduced via the bearing into the mentioned side cheeks laterally of the receiving groove 17.

In the FIGS. 3 and 4, the described cutting mechanism is not shown. In the grip-like body 10 preferably manufactured of plastic only the driving pin bearing 25 and the receiving bores 27 for the contact bow 24 are evident.

I claim:

1. In a can opener of a grip body (10) with a head (15) in which is accommodated a rotational cutting mechanism (20) for separating a can lid from a can, the improvement comprising: a pull hook (30) pivotally connected to the grip body (10), the pull hook (30) having a first end region near a pivot pin (31) about which the pull hook (30) pivots and having a second end region distant to the pivot pin (31), the pull hook (30) having an attachment recess (32) near the second end region, the attachment recess (32) forming a recess void which from an inner edge (35) of the pull hook (30) is directed inward within a body portion of the pull hook (30), the pull hook (30) having a convex rolling back (33) extending between the first end region and the second end region, and a pivoting movement of the pull hook (30) being limited by an abutment (19) on the grip body (10).

2. In a can opener according to claim 1, wherein the grip body (10) comprises a receiving groove (17) in which the pull hook (30) is pivotally positioned in a pivoted-in position, wherein a groove base (17') of the grip body (10) in the pivoted-in position forms the abutment (19).

3. In a can opener according to claim 2, wherein the pull hook (30) in the pivoted-in position partly projects out of the receiving groove (17).

4. In a can opener according to claim 1, wherein the pull hook (30) has a crescent shape formed by the inner edge (35) and the convex rolling back (33), wherein a radius of curvature ($r_1$, $r_2$) increases from near the attachment recess to near the pivot pin (31).

5. In a can opener according to claim 1, wherein the grip body (10) comprises a thickened end (16) positioned opposite a head (15) so that the head (15) and the thickened end (16) forms a grip trough (14) therebetween.

6. In a can opener according to claim 1, wherein the receiving groove (17) in the first end region at a pivot pin bearing (18) blends into an abutment recess.

7. In a can opener according to claim 1, wherein the grip body (10) comprises two parallel planar side surfaces (11) and a receiving groove is formed centrally and parallel to the side surfaces (11) in the grip body (10).

8. In a can opener according to claim 1, wherein the rotational cutting mechanism (20) comprises a traction wheel (21) rotationally seated on a traction pin (26), a rotary grip (22) actuating the traction wheel (21) and a cutting wheel (23).

9. In a can opener according to claim 1, wherein during actuation of the pull hook (30) the attachment recess (32) accommodates a pull ring (R) which is attached to a lid of a tear-open can.

10. In a can opener according to claim 1, wherein the attachment recess has a shape of one of approximately rectangular and approximately trapezoidal.

11. In a can opener having a grip body (10) with a head (15) in which is accommodated a rotational cutting mechanism (20) for separating a can lid from a can, the improvement comprising: the grip body (10) connected in a pivotally movable manner to a pull hook (30) for pulling a pull ring (R) attached to a lid of a tear-open can, the pull hook (30) having a first end region near a pivot pin and a second end region distant to the pivot pin (31), the pull hook (30) having an attachment recess (32) near the second end region, the pull hook (30) having a convex rolling back (33) extending between the first end region and the second end region, and a pivoting movement of the pull hook (30) being limited by an abutment (19) on the grip body (10), in a direction from the second end region toward the first end region of the pull hook (30), following the attachment recess (32), an inner edge (35) of the pull hook (30) configured to first follow a straight line and then to angle from the straight line and follow an angled location (36) of the inner edge (35) towards a pivot bow (37) section of the inner edge (35) which transitions into a contact edge (38), and in a pivoted-out position of the pull hook (30) the contact edge (38) abuts the abutment (19) on the grip body (10).

12. In a can opener according to claim 11, wherein a receiving groove base (17') of the grip body (10) runs according to a shape of the inner edge (35) of the pull hook (30) so that the groove base (17') is aligned with a center of a pivot pin bearing (18).

13. A can opener comprising: a grip body (10) having a head (15), a rotational cutting mechanism (20) rotatably mounted with respect to the head (15), a pull hook (30) pivotally mounted with respect to the grip body (10), the pull hook (30) having a first end region near a pivot pin (31) and a second end region distant to the pivot pin (31), the pull hook (30) having an attachment recess (32) near the second end region, during actuation of the pull hook (30) a pull ring (R) lying in the attachment recess (32), the pull hook (30) having a convex rolling back (33) extending between the first end region and the second end region, in a direction from the second end region to the first end region an inner edge (35) of the pull hook (30) following a straight line after the attachment recess (32) and angling inward within a body portion of the pull hook (30) and then angling outward away from the body portion and transitioning into a contact edge (38) of the pull hook (30), and during a pivoting movement of the pull hook (30) an abutment (19) on the grip body (10) contacting the contact edge (38).

* * * * *